United States Patent [19]
Baardsen
[11] 4,215,952
[45] Aug. 5, 1980

[54] OFFSHORE STRUCTURE FOR USE IN WATERS CONTAINING LARGE MOVING ICE MASSES

[75] Inventor: Per Baardsen, San Rafael, Calif.

[73] Assignee: Chevron Research Company, San Francisco, Calif.

[21] Appl. No.: 886,844

[22] Filed: Mar. 15, 1978

[51] Int. Cl.² ..... E02B 15/02

[52] U.S. Cl. ..... 405/211; 114/219; 405/215

[58] Field of Search ..... 61/102, 1 R, 48; 114/219; 273/55 D; 405/211, 215

[56] References Cited

U.S. PATENT DOCUMENTS

| | | | |
|---|---|---|---|
| 2,893,720 | 7/1959 | Bair | 114/219 X |
| 3,014,710 | 12/1961 | Layne | 114/219 X |
| 3,121,997 | 2/1964 | Sampson | 405/211 |
| 3,170,299 | 2/1965 | Clarke | 61/1 R |
| 3,283,515 | 11/1966 | Pottorf | 61/102 |
| 3,370,432 | 2/1968 | Butler et al. | 61/102 X |
| 3,581,505 | 6/1969 | Liddell | 61/102 |
| 3,788,082 | 1/1974 | Narabu | 114/219 |
| 3,798,912 | 3/1974 | Best et al. | 61/1 R |
| 3,831,385 | 8/1974 | Hudson et al. | 61/102 |
| 3,964,422 | 6/1976 | Boyd | 114/219 |
| 4,103,504 | 8/1978 | Ehrlich | 405/211 |

*Primary Examiner*—Dennis L. Taylor
*Attorney, Agent, or Firm*—R. L. Freeland, Jr.; William J. Egan, III

[57] ABSTRACT

An offshore structure for use in arctic waters containing large moving ice masses such as icebergs wherein the structure has a wear surface arranged around the periphery of its support portion at least in the region of the support portion of potential contact with moving ice masses. A layer of resilient material is disposed between the wear surface and the support portion in order to reduce the forces imposed on the structure by the impinging ice masses.

16 Claims, 7 Drawing Figures

OFFSHORE STRUCTURE FOR USE IN WATERS CONTAINING LARGE MOVING ICE MASSES

FIELD OF THE INVENTION

This invention relates to offshore structures and, more particularly, this invention relates to offshore structures for use in arctic waters containing large moving ice masses.

BACKGROUND OF THE INVENTION

In recent years, offshore exploration and production of petroleum products has been conducted in arctic regions such as northern Canada and Greenland. Offshore exploration and production in these areas have presented particular problems not found in more temperate climates. One of the major problems encountered in arctic offshore waters is the presence during much of the year of large moving ice masses such as ice floes or icebergs. Propelled by wind and sea currents, these large ice masses—ice-bergs having a depth of several hundred feet and a weight of several million tons are not uncommon in certain arctic regions—may travel considerable distances per day at relatively high velocities. Such large moving ice masses possess large amounts of kinetic energy and can impose very great forces on any offshore structure in their path, possibly causing extensive damage to the structure or even catastrophic failure of the structure. Therefore, offshore structures located in this type of environment must either be built strong enough to withstand the forces associated with a large impinging ice mass or must be able in some manner to reduce the forces imposed on the structure by the impinging ice mass.

The cost of building a structure strong enough to withstand such forces is generally considered to be prohibitively expensive; therefore, various concepts have been proposed for reducing the forces imposed on the structure by the impinging ice mass. One of these designs is described in U.S. Pat. No. 3,283,515, which discloses the use of a ring of outer support members encircling the inner support members of the offshore structure. The inner support members provide the main vertical support for the structure's platform while the outer support members prevent large ice masses from colliding with the inner support members. Means are also provided for damping the vibrations resulting from the impact of the ice mass with the outer protective support members.

Another approach for minimizing the impact of moving ice masses with an offshore platform is disclosed in U.S. Pat. No. 3,348,382 wherein the platform's vertical support columns are only cross-braced in the region from the water bottom to about 10 to 20 feet below the waterline and from about 10 feet above the water line to the bottom of the platform deck. Since all cross-bracing is eliminated throughout the vertical height of a so-called typically sized ice floe, the impinging ice floe will only come into contact with the vertical support columns of the platform. Therefore, the only force imposed on the structure by the ice floe is that associated with the breaking and shearing of the ice floe as it moves into contact with the vertical columns.

Still another approach to this problem is illustrated in U.S. Pat. No. 3,436,920, which discloses an iceberg protective system in which buoy-supported cables are arranged around an offshore platform at a considerable distance from the platform. This fending system, which may be augmented by drag anchors and crash tubes, is designed to effectively stop the forward motion of the iceberg thereby preventing the iceberg from colliding with the platform.

The systems proposed heretofore either involve the use of specially designed platforms, which may entail increased cost and time of construction, or external protective systems which are designed to prevent the major part of an impinging ice mass from colliding with an offshore structure. Although these systems offer some protection against impinging ice masses, they are not particularly suited for use in deeper waters which may contain relatively larger ice masses in that these systems become extremely complicated and costly to construct and repair. There is then a need for a system for reducing the forces imposed on an offshore structure by relatively large impinging ice masses, such a system being particularly adopted for use in deeper waters.

SUMMARY OF THE INVENTION

The present invention comprises an offshore structure which is adapted for use in arctic waters containing large moving ice masses. The offshore structure in accordance with the present invention broadly comprises a support portion extendible into a body of water having a wear surface attached to the support portion and arranged around the periphery of the support portion at least in the region of potential contact with moving ice masses. A void is formed between the support portion and the wear surface and is filled with a resilient material which is deflected when an ice mass collides with the structure. The deflection of the resilient material absorbs some of the kinetic energy possessed by the impinging ice mass and thus reduces the forces imposed on the structure by the ice mass. The wear surface receives the impact of the moving ice mass and protects the resilient material from damage that might be caused by the impact of the ice mass with the structure. The wear surface also transfers the force of the impact to the resilient material so that the material is deflected.

This invention may be adapted for use with various types of offshore structure designs which are to be used in waters containing large moving ice masses such as icebergs.

PRINCIPAL OBJECT OF THE INVENTION

A particular objective of the present invention is to reduce the forces imposed on an offshore structure by impinging ice masses by arranging a wear surface around the periphery of the support portion of the structure and filling the void formed between the support portion and the wear surface with a resilient material that is deflected when an ice mass impacts the wear surface.

Further objects and advantages of the present invention will become apparent from the following detailed description read in view of the accompanying drawings, which are made a part of this specification.

DESCRIPTION OF THE PREFERRED EMBODIMENT

Figure 1:
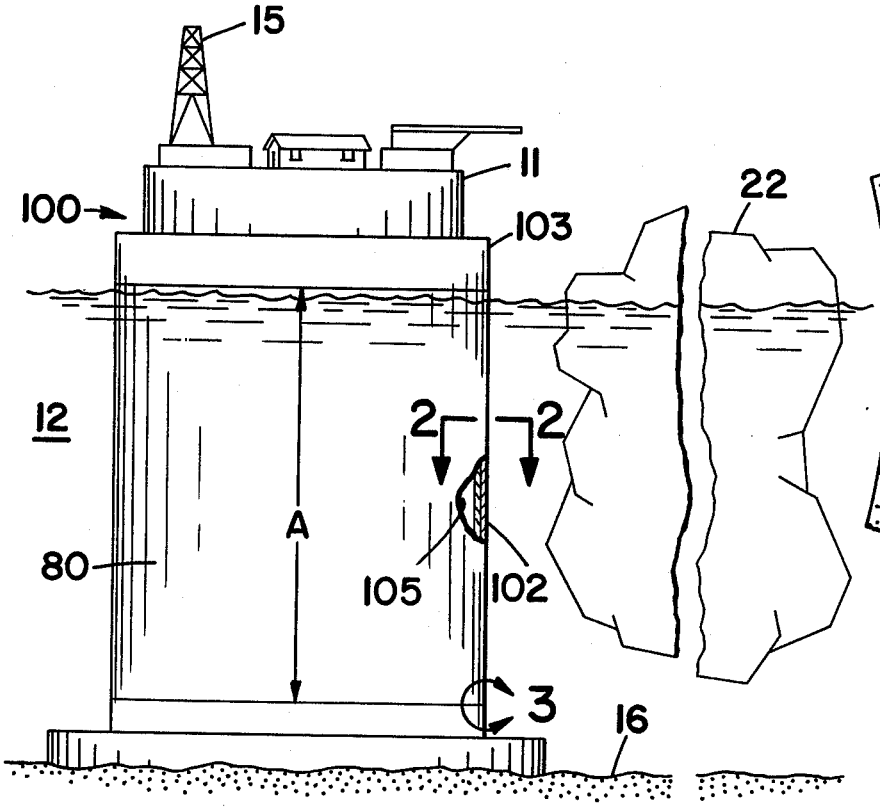
FIG. 1 is a schematic elevation view of an offshore structure illustrating the preferred embodiment of the invention.
Figure 2:
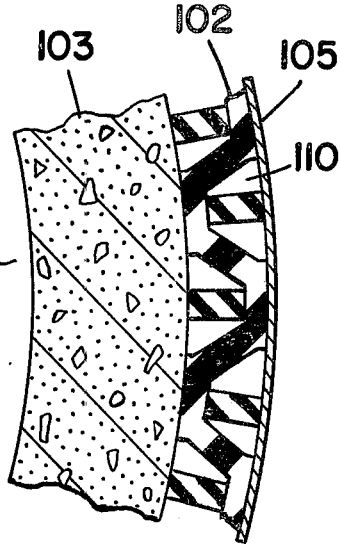
FIG. 2 is a cross-sectional view through the outer surface of the structure shown in FIG. 1 taken along line 2—2.
Figure 3:
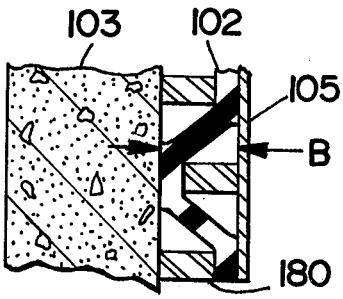
FIG. 3 is a sectional view taken from line 3 in FIG. 1.

Referring now to the drawings, and in particular to FIGS. 1-3, a preferred embodiment assembled in accordance with the present invention is illustrated as being applied to an offshore structure of the type known as a "fixed concrete gravity offshore platform," identified generally as 100. Gravity platforms are held in place on the underwater bottom by their own weight and the weight of any ballast added to the platform. On this type of structure, drilling and producing activities may be carried out, and, of course, drilling operations are conducted by means of a drill derrick 15 located on work platform 11. The platform has a support portion 80 which extends into the water 12 and forms a base for supporting the work platform 11 above the surface of the water. The work platform may contain several layers of decks and may be enclosed and heated to provide a reasonably comfortable working environment.

According to the embodiment of the invention shown in FIGS. 1-3, the support portion 80 of the offshore structure has a cylindrical shape with the outer surface 103 of the support portion constructed from concrete. The support portion is exposed to water and ice forces incident to its environment, such as iceberg 22 which is moving in the direction of offshore structure 100, and is that portion of the structure of principal interest to the present invention.

The danger of impact between iceberg 22 and structure 100 is a serious hazard to drilling operations being conducted on the structure, but more serious, as indicated hereinabove, is the danger of damage to or catastrophic failure of the offshore structure. Accordingly, there is provided in accordance with the present invention an effective system for reducing the forces imposed on the structure by the impinging ice mass. This system includes a novel combination of a wear surface 105 and a layer of energy absorbing resilient material 102. As shown, the layer of resilient material 102 is disposed against the outer surface 103 of support portion 80 at least in the region thereof for which there is a potential for contact with moving ice masses such as iceberg 22. The region of potential contact is indicated generally by A and corresponds essentially to the draft of the largest ice mass that would be expected to be encountered in the waters in which the platform is to be located.

As more particularly shown in FIGS. 2 and 3, wear surface 105 is concentrically arranged around the periphery of support portion 80 at least in the region of the support portion of potential contact with iceberg 22. The wear surface is arranged with respect to the support portion such that an open area or annular void 190 having a width B of at least six inches is formed therebetween. Extending radially outward from and around the periphery of support portion 80 is a flange member 180 to which wear surface 105 is welded or otherwise appropriately secured. In this manner, wear surface 105 is affixed to support portion 80.

Figure 5:
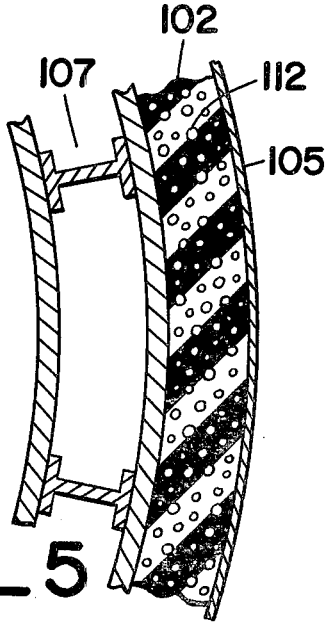
FIG. 5 is a cross-sectional view through the outer surface of the structure shown in FIG. 4 taken along line 5—5.

The layer of resilient material 102 is disposed between and enclosed by support portion 80 and wear surface 105 substantially filling or occupying the open area 190. As will be discussed in more detail below, when an iceberg 22 collides with the offshore structure, the layer of resilient material deflects inwardly absorbing the kinetic energy associated with the impinging ice mass in order to reduce the forces imposed on the structure. Accordingly, layer 102 is made from a suitably resilient material such as neoprene; although, certain other materials such as a natural rubber composition or a resilient plastic may be used. To assure adequate deflection of layer 102 and thus optimum energy-absorbing capacity, the configuration of layer 102 should include some type of open space 110 in its cross-sectional area. Of course, the open space could be of any appropriate geometrical arrangement as illustrated in FIG. 5 wherein the open space is defined by circular openings 112. The means of attaching layer 102 to outer surface 103 could be accomplished by adhesive bonding or mechanical fastening. (See "Modern Plastics Encyclopedia" for ways to fasten layer 102 to the outer surface 103.)

As discussed previously, wear surface 105 is concentrically arranged around support portion 80 with the layer of resilient material 102 "sandwiched" between the support portion and the wear surface. The wear surface receives the impact of the ice mass 22 moving into contact with the structure 100 in order to protect layer 102 against damage caused by the impinging ice mass. Therefore, wear surface 105 is constructed from an impact and wear resistant material. The selected material must also be deformable in order that the forces associated with the impinging ice mass are transferred to layer 102 so that layer 102 is deflected inwardly. Examples of such materials are wood laminates, steel or certain plastics such as acrylonitrile-butadiene-styrene, ionomer polyvinyl chloride polycarbonate or nylon. Preferably, the wear surface is constructed of a one-half inch steel wear plate, which is both resistant to wear and abrasion and which has the abovedescribed force-transferring characteristics. It should also be noted that subsequent to impact, as the ice mass moves around and away from the structure, the wear surface will return substantially to its initial position as the force transferred to layer 102 subsides.

A typically sized iceberg 22 for the waters in which the structure 100 might be located has a weight of $2.5\times10^6$ tons and travels at a speed of approximately 0.17 feet per second. Therefore, the kinetic energy for this ice mass is calculated as follows (ignoring the added mass of the water pushed in front of the moving ice mass):

$$\text{Ice mass } KE = \tfrac{1}{2}\,(\text{mass})(\text{velocity})^2 \qquad (1)$$

$$= \frac{(2.5\times10^6\text{ tons})(2\text{ kips/ton})(0.17\text{ ft/sec}\times12\text{ in/ft})^2}{(386.4\text{ in/sec}^2)(2)}$$

[where 2 kips = 1 metric ton of force]

= 26,925 kips-in

To calculate the amount of energy that may be absorbed by layer 102 and thus the force imposed on the structure by the ice mass, it is only necessary to determine the area under the resilient material's force-displacement curve, which is plot of the deflection of the layer of resilient material on the X-axis versus the compressive strength of the ice mass on the Y-axis, between any two points of deflection. For example, assuming that the deflection ($\alpha$) of layer 102 is directly proportional to the force imposed on the structure by the impinging ice mass and that the maximum deflection of layer 102 is equal to 2.5 inches and further assuming that the compressive strength of ice ($\Delta$) is equal to 200 psi, then the energy absorbing capacity of layer 102 is caclulated as follows:

$$\begin{aligned}\text{Energy capacity} &= \tfrac{1}{2}(\alpha)(\Delta) \\ &= \tfrac{1}{2}(200\ \text{lbs/in}^2)(2.5\ \text{in})(1\ \text{kip/1000 lbs}) \\ &\quad [\text{where 1 kip} = 1000\ \text{pounds of force}] \\ &= 0.25\ \text{kip-in/in}^2\end{aligned} \tag{2}$$

Having determined the energy-absorbing capacity of layer 102, the total force imposed on the structure by iceberg 22 may now be calculated. First, the contact area between the ice mass and the structure is determined from the kinetic energy of the ice mass and the energy capacity of layer 102:

$$\begin{aligned}\text{Contact area} &= \text{Ice mass } KE/\text{Energy capacity} \\ &= 26{,}925\ \text{kips-in}/0.25\ \text{kip-in/in}^2 \\ &= 107.7 \times 10^3\ \text{in}^2\end{aligned} \tag{3}$$

The total force imposed on the structure by the impinging ice mass is then the product of the contact area of the ice mass with the structure and the compressive strength of the ice mass:

$$\begin{aligned}&\text{Total force imposed on structure by impinging ice mass} \\ &= (107.7 \times 10^3\ \text{in}^2)(200\ \text{lbs/in}^2)(1\ \text{kip/1000 lbs}) \\ &= 21{,}540\ \text{kips}\end{aligned} \tag{4}$$

From the foregoing, it can be seen that the total force imposed on the structure by the impinging ice mass is reduced to the amount of 21,540 kips, this force being inversely proportional to the energy absorbing capacity of layer 102.

The reduction of the force imposed on the structure by the impinging ice mass has the obvious effect of reducing the overturning moment imposed on the structure. Assuming that the structure 100 has a height of 500 feet and that the iceberg impacts the structure at a point approximately 350 feet from the underwater bottom 16, the overturning moment imposed on the structure may be calculated:

$$\begin{aligned}\text{Overturning moment} &= (21{,}540\ \text{kips})(350\ \text{ft}) \\ &= 7.539 \times 10^6\ \text{kips-ft}\end{aligned} \tag{5}$$

Since the overturning moment imposed on the structure by the impinging ice mass is reduced, the loading on the underwater bottom supporting structure 100 is likewise reduced, permitting the structure to be utilized in areas which otherwise could not support this type of structure.

Figure 4:
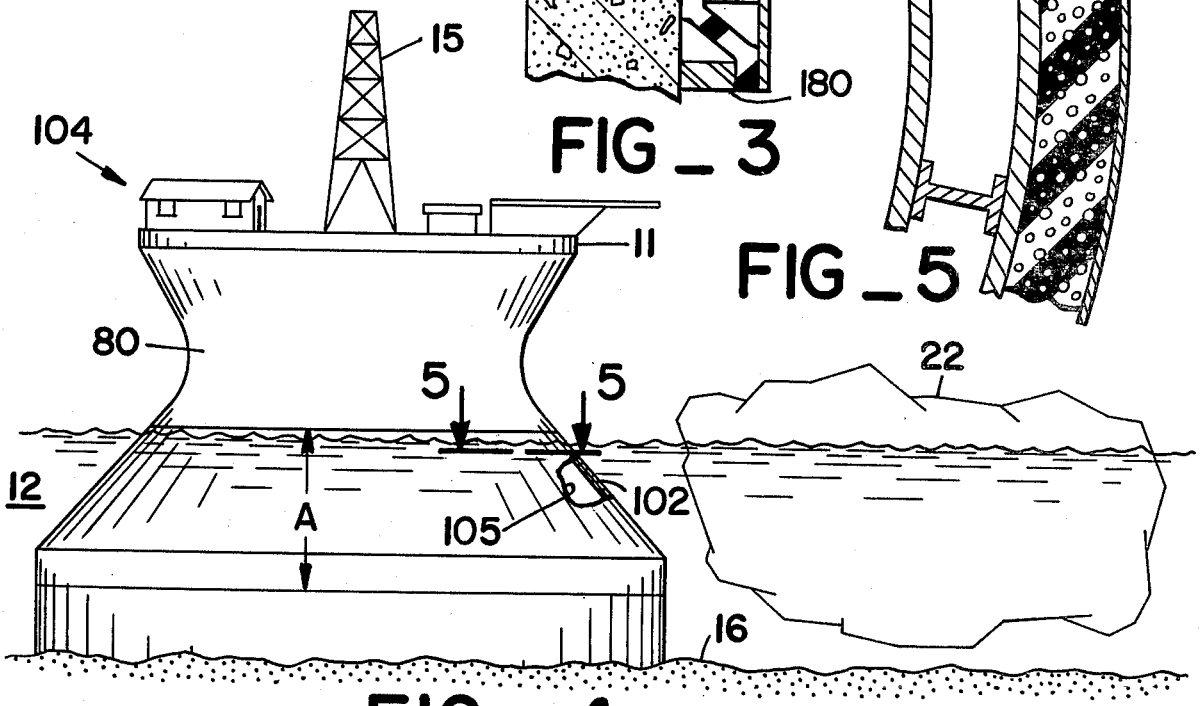
FIG. 4 is a schematic elevation view showing the present invention as applied to a frustoconical-based offshore structure.

It will, of course, be apparent that the present invention may be readily adapted for use with other types of offshore structures, as illustrated in FIGS. 4 through 7. FIGS. 4 nd 5 illustrate the present system being applied to a frustroconicalbased platform 104 which has a frustoconical-shaped support portion 80 conversing upwardly and inwardly of the underwater bottom 16. As discussed above, a wear surface 105 is arranged around the periphery of support 80 at least in the region A of potential contact with moving ice masses 22. The layer of resilient material 102 is disposed between wear surface 105 and the outer surface 107 of the support portion in order to reduce the forces imposed on structure 104 by the impacting ice masses.

Figure 6:
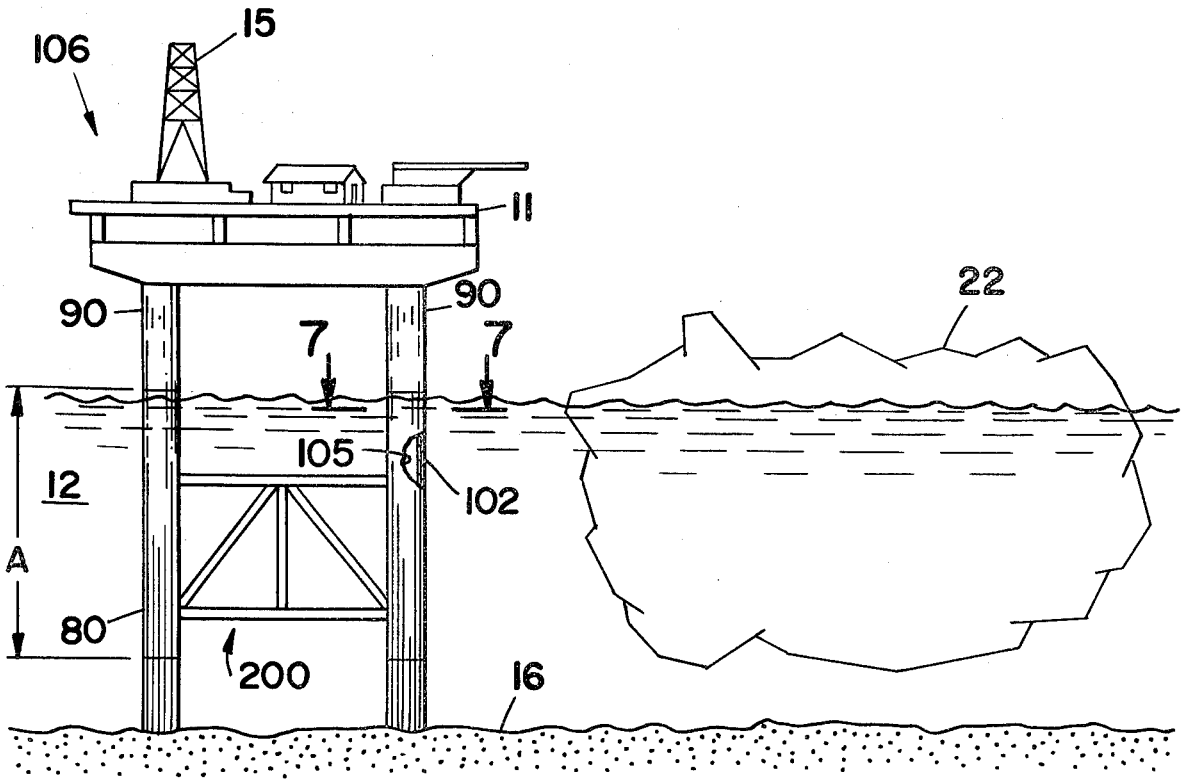
FIG. 6 is a schematic elevation view showing the present invention as applied to a platform supported by a plurality vertical support columns.
Figure 7:
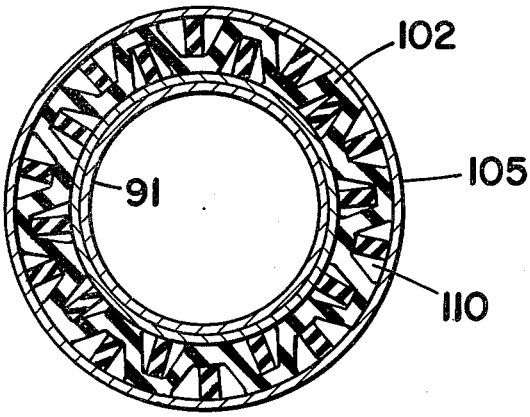
FIG. 7 is a cross-sectional view taken along line 7—7 of FIG. 6.

FIGS. 6 and 7 illustrate the present invention being applied to an offshore structure 106 wherein the support portion 80 comprises a plurality of substantially vertical spaced-apart support columns or legs 90. The wear surface is concentrically arranged around the periphery of each individual column 90 at least in the region A of potential contact with moving ice masses. The layer of resilient material 102 is disposed between the outer surface 91 of column 90 and the wear surface 105. Additionally, the wear surface 105 and layer 102 may be utilized with respect to the cross-bracing members of the structure, indicated generally by 200.

Although certain specific embodiments of the invention have been described herein in detail, the invention is not to be limited to only such embodiments, but rather only by the appended claims.

What is claimed is:

1. An offshore structure for use in arctic waters containing relatively large moving ice masses, comprising:

a support portion extendible into a body of water for supporting a work platform above the surface of the body of water;

means for securing said support portion to the bottom of the body of water;

a wear surface arranged around the entire periphery of said support portion at least in the region of potential contact with relatively large moving ice masses forming a void between said support portion and said wear surface, said wear surface adapted to receive the impact of relatively large ice masses moving into contact therewith; and a layer of resilient material disposed between and in contact with said support portion and said wear surface filling said void, said wear surface transferring the forces associated with the impinging ice mass to said resilient material so that said resilient material deflects when said wear surface is impacted by the relatively large moving ice mass and said resilient material of sufficient thickness to substantially reduce the forces imposed on the support portion by the moving ice mass.

2. An offshore structure for use in arctic waters containing relatively large moving ice masses, comprising:

a support portion extendible into a body of water for supporting a work platform above the surface of the body of water;

means for securing said support portion to the bottom of the body of water;

a wear surface concentrically arranged around the entire periphery of said support portion at least in the region of potential contact with relatively large moving ice masses forming an annular void between said support portion and said wear surface, said wear surface adapted to receive the impact of relatively large ice masses moving into contact therewith;

means for affixing said wear surface to said support portion; and a layer of resilient material disposed between and in contact with said support portion and said wear surface filling said annular void, said wear surface transferring the forces associated with the impinging ice mass to said resilient material so that said resilient material deflects when said wear surface is impacted by the relatively large moving ice mass and said resilient material of sufficient thickness to substantially reduce the forces imposed on the support portion by the moving ice mass.

3. The offshore structure of claim 2 wherein said layer of resilient material is made from neoprene and wherein said wear surface is constructed from steel.

4. The offshore structure of claim 3 wherein said neoprene has a thickness of at least six inches and said steel has a thickness of at least one-half inch.

5. The offshore structure of claim 2 wherein the support portion has a cylindrical shape and is secured to the bottom of the body of water by the force of gravity.

6. The offshore structure of claim 2 wherein the support portion has a frustoconical form converging upwardly and inwardly of the bottom of the body of water.

7. The offshore structure of claim 2 wherein the support portion comprises a plurality of substantially vertical spacedapart legs.

8. In an offshore structure for use in a body of water which contains relatively large moving ice masses, which structure includes a support portion extendible into a body of water for supporting a work platform above the surface of the body of water, said support portion having an outer surface extendible from below the surface of the body of water to above the surface and means for affixing said support portion to the bottom of the body of water, the improvement comprising: a resilient material attached to the entire outer surface of said support portion at least in the region of said support portion of potential contact with relatively large moving ice masses, said resilient material being deflected when impacted by a relatively large moving ice mass and said resilient material of sufficient thickness to substantially reduce the forces imposed on the structure by the ice mass moving into contact with said support portion and a wear surface arranged around said resilient material.

9. A method for reducing the forces imposed on an offshore structure by relatively large moving ice masses which come into contact with the support portion of the structure, comprising:

positioning a wear surface around the entire periphery of the support portion at least in the region of potential contact with relatively large moving ice masses to form a void between the support portion and said wear surface, said wear surface adapted to receive the impact of relatively large ice masses moving into contact therewith;

disposing a layer of resilient material between and in contact with the support portion and said wear surface to fill said void, wherein said resilient material deflects when said wear surface is impacted by the relatively large moving ice mass; and forming said resilient material of sufficient thickness so that when said resilient material deflects when said wear surface is impacted by the relatively large moving ice mass the forces imposed on the structure by the impacting ice mass are substantially reduced.

10. A method for reducing the forces imposed on an offshore structure by relatively large moving ice masses which come into contact with the support portion of the structure, comprising:

positioning a wear surface concentrically around the entire periphery of the support portion at least in the region of potential contact with relatively large moving ice masses to form an annular void between the support portion and said wear surface, said wear surface adapted to receive the impact of relatively large ice masses moving into contact therewith;

affixing said wear surface to said support portion;

disposing a layer of resilient material between and in contact with the support portion and said wear surface to fill said annular void, wherein said resilient material deflects when said wear surface is impacted by the relatively large moving ice mass; and forming said resilient material of sufficient thickness so that when said resilient material deflects when said wear surface is impacted by the relatively large moving ice mass the forces imposed on the structure by the impacting ice mass are substantially reduced.

11. The method of claim 10 wherein said resilient material is made from neoprene and wherein said wear surface is constructed from steel.

12. The method of claim 11 wherein said neoprene has a thickness of at least six inches and said wear surface has a thickness of at least one-half inch.

13. The method of claim 10 wherein the support portion of the offshore structure has a cylindrical shape and is positionable on the bottom of the body of water by the force of gravity.

14. The method of claim 10 wherein the support portion of the offshore structure has a frustoconical form.

15. The method of claim 10 wherein the support portion of the offshore structure comprises a plurality of substantially vertical spaced-apart legs.

16. A method for reducing the forces imposed on an offshore structure by relatively large moving ice masses which come into contact with the support portion of the structure, comprising:

attaching a resilient material to the entire outer surface of the support portion in the region of the support portion of potential contact with relatively large moving ice masses, said resilient material being deflected when impacted by a relatively large moving ice mass;

forming said resilient material of a sufficient thickness so that when said resilient material deflects when the structure is impacted by a relatively large moving ice mass the forces imposed on the structure by the impacting ice mass are substantially reduced; and arranging a wear surface around said resilient material.

* * * * *